US005419494A

United States Patent [19]

Harwood

[11] Patent Number: 5,419,494

[45] Date of Patent: May 30, 1995

[54] LAWN SPRINKLER APPARATUS

[76] Inventor: Richard W. Harwood, 103 Nicely St., Advance, Ind. 46102

[21] Appl. No.: 240,640

[22] Filed: May 11, 1994

[51] Int. Cl.[6] ..... B05B 3/06

[52] U.S. Cl. ..... 239/211; 239/251; 239/276; 239/310; D23/215; D23/217

[58] Field of Search ..... 239/211, 251, 276, 310; D23/214, 215, 217, 220–222

[56] References Cited

U.S. PATENT DOCUMENTS

| | | | |
|---|---|---|---|
| D. 200,949 | 4/1965 | Nelson et al. | D23/215 |
| D. 225,400 | 12/1972 | Williams | D23/215 |
| 2,241,092 | 5/1941 | Jurgilanis | 239/211 |
| 2,954,932 | 10/1960 | Albano | 239/251 |
| 3,178,116 | 4/1965 | Cucuzza et al. | 239/276 |
| 3,933,308 | 1/1976 | Bradley et al. | 239/310 |
| 4,033,509 | 7/1977 | Sheets | 239/226 |
| 4,870,991 | 10/1989 | McMillan et al. | 239/310 |
| 5,031,838 | 7/1991 | Vydrzal | 239/280 |
| 5,096,123 | 3/1992 | Petitgoue | 239/310 |
| 5,111,993 | 5/1992 | Baker | 239/211 |
| 5,261,603 | 11/1993 | Driska | 239/251 |
| 5,297,979 | 3/1994 | Amron | 239/211 |

FOREIGN PATENT DOCUMENTS

| | | | |
|---|---|---|---|
| 2301305 | 10/1976 | France | 239/211 |

*Primary Examiner*—Karen B. Merritt

[57] ABSTRACT

A new and improved lawn sprinkler apparatus includes a portable, nonrotating body assembly which includes an adaptor assembly for connecting to a water source. The body assembly includes an internal water flow path. A rotatable sprinkler head assembly receives water from the water flow path and dispenses water through a plurality of water nozzles supported by the rotatable sprinkler head assembly. A rotatable, water-tight connection assembly connects the rotatable sprinkler head assembly to the water flow path of the body assembly. A rotatable decorative assembly is connected to the body assembly. The decorative assembly includes a paddle wheel which is driven by water flowing in the water flow path. The body assembly simulates a helicopter body; the rotatable sprinkler head assembly simulates a main helicopter rotor; and the decorative assembly simulates a helicopter tail rotor. A fertilizer containment chamber assembly is supported by and is contained within the body assembly and is placed in-line with the water flow path. The rotatable, water-tight connection assembly includes a stationary sealing surface connected to the body assembly and includes a rotatable sealing surface connected to the rotatable sprinkler head assembly. A simulated helicopter ground-contacting assembly is connected to a bottom side of the body assembly for supporting the body assembly on a ground. A ground-penetrating spike is connected to the body assembly for penetrating into a portion of ground for preventing the body assembly from moving along the ground.

8 Claims, 3 Drawing Sheets

LAWN SPRINKLER APPARATUS

BACKGROUND OF THE INVENTION

1. Field of the Invention

The present invention relates generally to lawn watering devices and, more particularly, to a lawn sprinkler device that includes rotating sprinkler heads.

2. Description of the Prior Art

To water a lawn a number of options are possible, and a very popular technique involves the use of sprinkler devices which employ rotating sprinkler heads. The rotating sprinkler heads water a circular portion of the lawn with the rotating sprinkler heads at the center of the circle. Aside from watering, sprinkler devices are often also used for distributing water soluble fertilizer along with the water.

Throughout the years, a number of innovations have been developed relating to lawn sprinklers, and the following U.S. Pat. Nos. are representative of some of those innovations: 4,033,509; 4,870,991; 5,031,838; 5,096,123; and 5,111,993. More specifically, U.S. Pat. Nos. 4,033,509, 4,870,991, and 5,096,123 disclose lawn sprinkler devices that both water a lawn and spread a water soluble fertilizer dissolved in the water. U.S. Patent Nos. 5,031,838 and 5,111,993 disclose other lawn sprinkler devices. U.S. Pat. No. 5,111,993 is of special interest for its disclosure of a lawn sprinkler that is in the form of a fire hydrant.

The patents cited above, except for U.S. Pat. No. 5,111,993, disclose sprinkler devices that are purely utilitarian in design and construction. Since a lawn sprinkler is dearly visible to neighbors and passers by when placed on a lawn, it would be desirable if a lawn sprinkler device had both utilitarian and decorative features. Such a lawn sprinkler is disclosed in U.S. Pat. No. 5,111,993 which discloses a simulated fire hydrant. Although the fire hydrant lawn sprinkler has decorative features and may be moved to different lawn locations, a real fire hydrant is a substantially static and stationary structure. Such a substantially static and stationary structure may be deemed to be an uninteresting decoration. In this respect, it would be desirable if a lawn sprinkler device were provided which simulated a moving object.

Generally, with lawn sprinklers that have rotating sprinkler heads, the rotating sprinkler heads are the only portions of the lawn sprinkler that visibly rotate. In this respect, it would be desirable if a lawn sprinkler device were provided which had rotating ornamental elements that rotated in conjunction with the rotating sprinkler heads.

Not only would it be desirable for a lawn sprinkler to have rotating ornamental portions that rotated in conjunction with the rotating sprinkler heads, it would also be desirable if the rotating sprinkler heads and the rotating ornamental elements formed part of the same simulated device.

In lawn sprinklers having rotating sprinkler heads, water pressure from a water source is what drives the rotating heads. More specifically, water exits from one side of a rotating head. Equal and opposite reaction forces cause the rotating head to rotate in a direction opposite to the direction of water exit. The flow of pressurized water can also be used to rotate a decorative rotating element without using reactive forces to water emission. That is, the rotating decorative element can be caused to rotate by forces generated by internal water flow.

When a lawn sprinkler is placed on a lawn, it is desirable that the sprinkler remain in the location that it is placed. However, a number of factors may tend to cause the lawn sprinkler to move or shift. One factor is the wind. Another factor is the reactive forces of the water flowing from the rotating sprinkler arms. In this respect, it would be desirable if a lawn sprinkler device were provided with features that assured that the device remained in a particular position on the lawn on which the device is placed.

In a lawn sprinkler device that also dispenses a water soluble lawn fertilizer, it would be desirable for the device to be readily filled with the fertilizer. Moreover, to assure complete dispersal of the fertilizer, it would be desirable for a fertilizer receiving chamber to be in-line with the path of water flow in the lawn sprinkler device.

Thus, while the foregoing body of prior art indicates it to be well known to use rotating lawn sprinklers, the prior art described above does not teach or suggest a rotating lawn sprinkler apparatus which has the following combination of desirable features: (1) has both utilitarian and decorative features; (2) simulates a moving object; (3) has rotating ornamental elements that rotate in conjunction with rotating sprinkler heads; (4) has rotating sprinkler heads and rotating ornamental elements which form parts of the same simulated device; (5) has a rotating decorative element which is caused to rotate by forces generated by internal water flow; (6) is provided with features that assure that the device remains in a particular position on the lawn on which the device is placed; (7) is readily filled with fertilizer; and (8) has a fertilizer receiving chamber which is in-line with the path of water flow in the lawn sprinkler device. The foregoing desired characteristics are provided by the unique lawn sprinkler apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved lawn sprinkler apparatus which includes a portable, nonrotating body assembly which includes an adaptor assembly for connecting to a water source. The body assembly includes an internal water flow path. A rotatable sprinkler head assembly receives water from the water flow path and dispenses water through a plurality of water nozzles supported by the rotatable sprinkler head assembly. A rotatable, water-tight connection assembly connects the rotatable sprinkler head assembly to the water flow path of the body assembly. A rotatable decorative assembly is connected to the body assembly. The decorative assembly includes a water-flow-responsive drive assembly which is driven by water flowing in the water flow path. The adaptor assembly is a threaded adaptor for connecting to a garden hose.

The body assembly is in a form of a helicopter body, the rotatable sprinkler head assembly is in a form of a main helicopter rotor, and the decorative assembly is in a form of a helicopter tail rotor. The water-flow-responsive drive assembly is a paddle wheel which includes a plurality of paddles.

A fertilizer containment chamber assembly is supported by and is contained within the body assembly. The fertilizer containment chamber assembly is placed in-line with the water flow path.

The rotatable, water-tight connection assembly includes a stationary sealing surface connected to the body assembly and includes a rotatable sealing surface connected to the rotatable sprinkler head assembly.

A ground-contacting assembly is connected to a bottom side of the body assembly for supporting the body assembly on a ground. The ground-contacting assembly is in a form of a helicopter ground-contacting assembly.

A ground-penetrating assembly is connected to the body assembly for penetrating into a portion of ground for preventing the body assembly from moving along the ground.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved lawn sprinkler apparatus which has all of the advantages of the prior art and none of the disadvantages.

It is another object of the present invention to provide a new and improved lawn sprinkler apparatus which may be easily and efficiently manufactured and marketed.

It is a further object of the present invention to provide a new and improved lawn sprinkler apparatus which is of durable and reliable construction.

An even further object of the present invention is to provide a new and improved lawn sprinkler apparatus which is susceptible of a low cost of manufacture with regard to both materials and labor, and which accordingly is then susceptible of low prices of sale to the consuming public, thereby making such lawn sprinkler apparatus available to the buying public.

Still yet a further object of the present invention is to provide a new and improved lawn sprinkler apparatus which has both utilitarian and decorative features.

Still another object of the present invention is to provide a new and improved lawn sprinkler apparatus that simulates a moving object.

Yet another object of the present invention is to provide a new and improved lawn sprinkler apparatus which has rotating ornamental elements that rotate in conjunction with rotating sprinkler heads.

Even another object of the present invention is to provide a new and improved lawn sprinkler apparatus that has rotating sprinkler heads and rotating ornamental elements which form parts of the same simulated device.

Still a further object of the present invention is to provide a new and improved lawn sprinkler apparatus which has a rotating decorative element which is caused to rotate by forces generated by internal water flow.

Yet another object of the present invention is to provide a new and improved lawn sprinkler apparatus that is provided with features that assure that the device remains in a particular position on the lawn on which the device is placed.

Still another object of the present invention is to provide a new and improved lawn sprinkler apparatus which is readily filled with fertilizer.

Yet another object of the present invention is to provide a new and improved lawn sprinkler apparatus that has a fertilizer receiving chamber which is in-line with the path of water flow in the lawn sprinkler device.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved lawn sprinkler apparatus embodying the principles and concepts of the present invention will be described.

Figure 1:
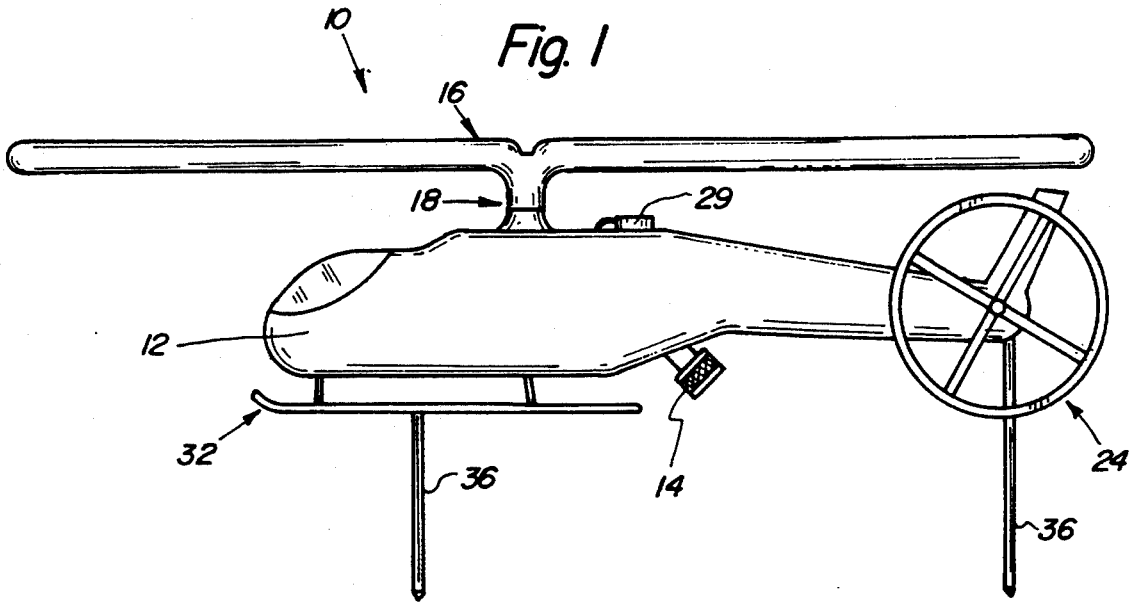
FIG. 1 is a side view showing a preferred embodiment of the lawn sprinkler apparatus of the invention which simulates a helicopter.
Figure 2:
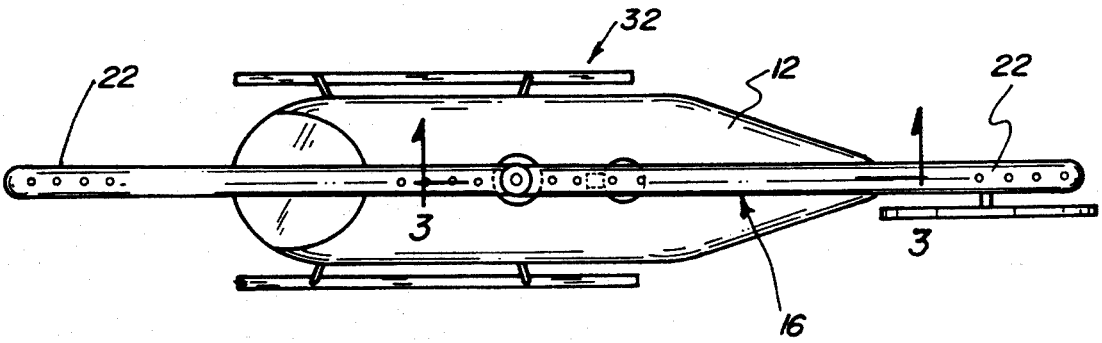
FIG. 2 is a top view of the embodiment of the lawn sprinkler apparatus shown in FIG. 1.
Figures 3, 4:
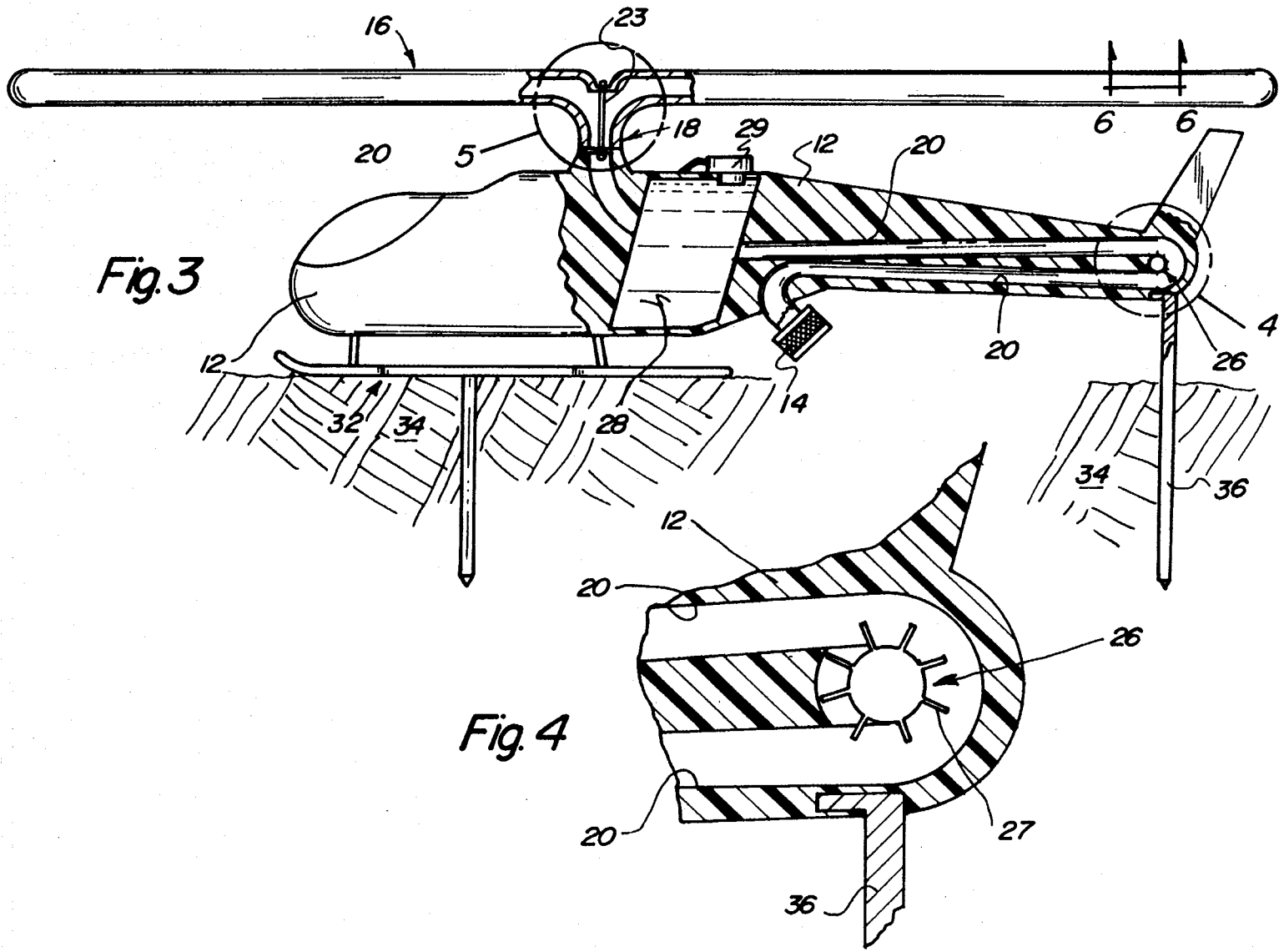
FIG. 3 is an enlarge partial side view and partial cross-sectional view of the embodiment of the lawn sprinkler apparatus of FIG. 2 taken along line 3—3 thereof.
FIG. 4 is an enlarged cross-sectional view of the portion of the embodiment of the invention shown in FIG. 3 that is in the circled region 4 in FIG. 3.
Figure 5:
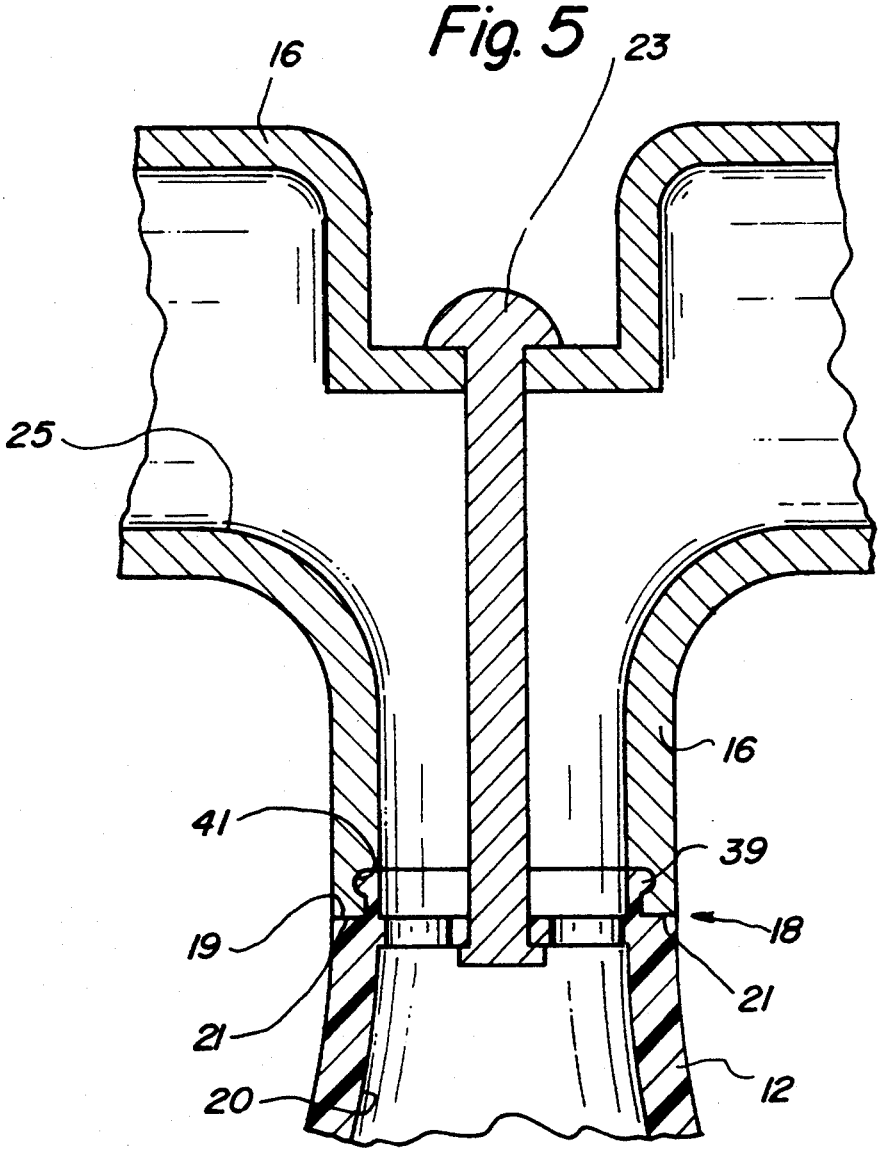
FIG. 5 is an enlarged cross-sectional view of the portion of the embodiment of the invention shown in FIG. 3 that is in the circled region 5 of FIG. 3.
Figure 6:
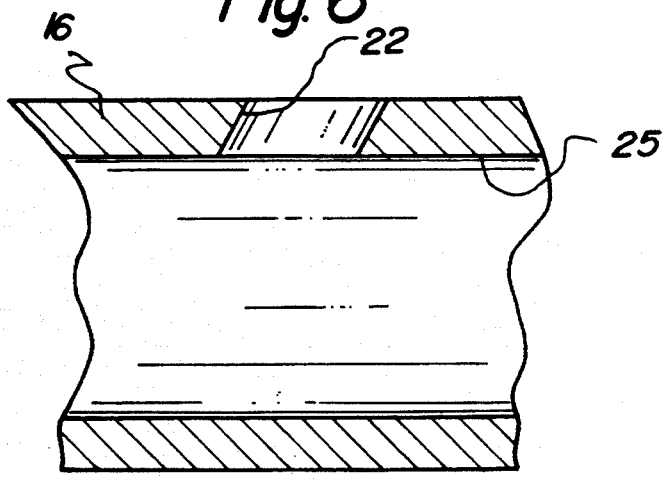
FIG. 6 an enlarged cross-sectional view of the portion of the embodiment of the invention shown in FIG. 3 that is taken along line 6—6 of FIG. 3.

Turning to FIGS. 1–6, there is shown an exemplary embodiment of the lawn sprinkler apparatus of the invention generally designated by reference numeral 10. In its preferred form, lawn sprinkler apparatus 10 includes a portable, nonrotating body assembly 12 which includes an adaptor assembly 14 for connecting to a water source. The body assembly 12 includes an internal water flow path 20. A rotatable sprinkler head assembly 16 receives water from the water flow path 20 and dispenses water through a plurality of water nozzles 22 supported by the rotatable sprinkler head assembly 16. A rotatable, water-tight connection assembly 18 connects the rotatable sprinkler head assembly 16 to the water flow path 20 of the body assembly 12. A rotatable decorative assembly 24 is connected to the body assembly 12. The decorative assembly 24 includes a water-flow-responsive drive assembly which is driven by water flowing in the water flow path 20. The adaptor assembly 14 is a threaded adaptor for connecting to a garden hose.

The body assembly 12 is in a form of a helicopter body; the rotatable sprinkler head assembly 16 is in a form of a main helicopter rotor; and the decorative assembly 24 is in a form of a helicopter tail rotor.

The water-flow-responsive drive assembly is a paddle wheel 26 which includes a plurality of paddles 27. The paddle wheel 26 is connected to the decorative assembly 24, which is in the form of a helicopter tail rotor. The paddle wheel 26 causes the helicopter tail rotor to rotate when water flows through the water flow path 20.

A fertilizer containment chamber assembly 28 is supported by and is contained within the body assembly 12. The fertilizer containment chamber assembly 28 is placed in-line with the water flow path 20. The fertilizer containment chamber assembly 28 includes a removable cap 29 for adding fertilizer to the fertilizer containment chamber assembly 28.

The rotatable, water-tight connection assembly 18 includes a stationary sealing surface 19 connected to the body assembly 12 and includes a rotatable sealing surface 21 connected to the rotatable sprinkler head assembly 16. A rivet 23 is used to align the rotatable sprinkler head assembly 16 on the body assembly 12. The body assembly 12 has a flange portion 39 that fits into a complementary groove portion 41 on the rotatable sprinkler head assembly 16. The fit of the flange portion 39 into the groove 41 helps provide a water-tight seal between the body assembly 12 and the rotatable sprinkler head assembly 16. The water flow path 20 in the body assembly 12 is continuous with a complementary water flow path 25 in the rotatable sprinkler head assembly 16.

In use, water flows from a water source (not shown), through the adaptor assembly 14 on the body assembly 12, past the water-flow-responsive drive assembly, through the fertilizer containment chamber assembly 28, past the rotatable, water-tight connection assembly 18, through the water flow path 25 in the rotatable sprinkler head assembly 16, and out the water nozzles 22. When water flows out of the water nozzles 22, the rotatable sprinkler head assembly 16 is caused to rotate due to reactive forces. When water flows past the water-flow-responsive drive assembly, the paddles 27 receive force from the flowing water and cause the helicopter tail rotor decorative assembly 24 to rotate.

A ground-contacting assembly 32 is connected to a bottom side of the body assembly 12 for supporting the body assembly 12 on a ground 34. The ground-contacting assembly 32 is in a form of a helicopter ground-contacting assembly.

A ground-penetrating assembly is connected to the body assembly 12 for penetrating into a portion of ground 34 for preventing the body assembly 12 from moving along the ground 34. The ground-penetrating assembly can also be attached to the ground-contacting assembly 32. The ground-penetrating assembly is in the form of a spike 36.

The components of the lawn sprinkler apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved lawn sprinkler apparatus that is low in cost, relatively simple in design and operation, and which may advantageously be used to provide both utilitarian and decorative features. With the invention, a lawn sprinkler apparatus is provided which simulates a moving object. With the invention, a lawn sprinkler apparatus is provided which has rotating ornamental elements that rotate in conjunction with rotating sprinkler heads. With the invention, a lawn sprinkler apparatus is provided which has rotating sprinkler heads and rotating ornamental elements which form parts of the same simulated device. With the invention, a lawn sprinkler apparatus is provided which has a rotating decorative element which is caused to rotate by forces generated by internal water flow. With the invention, a lawn sprinkler apparatus is provided which has features that assure that the device remains in a particular position on the lawn on which the device is placed. With the invention, a lawn sprinkler apparatus is provided which is readily filled with fertilizer. With the invention, a lawn sprinkler apparatus is provided which has a fertilizer receiving chamber which is in-line with the path of water flow in the lawn sprinkler device.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as:

1. A new and improved lawn sprinkler apparatus, comprising:

a portable, nonrotating body assembly which is in a form of a helicopter body and which includes an adaptor assembly for connecting to a water source, said body assembly including an internal water flow path, a rotatable sprinkler head assembly which is in a form of a main helicopter rotor and which receives water from said water flow path and which dispenses water from said rotatable sprinkler head assembly through a plurality of water nozzles supported by said rotatable sprinkler head assembly, a rotatable, water-tight connection assembly for connecting said rotatable sprinkler head assembly to said water flow path of said body assembly, and a rotatable decorative assembly which is in a form of a helicopter tail rotor and which is connected to said body assembly, said decorative assembly including a water-flow-responsive drive assembly which is driven by water flowing in said water flow path.

2. The apparatus described in claim 1 wherein said adaptor assembly is a threaded adaptor for connecting to a garden hose.

3. The apparatus described in claim 1 wherein said water-flow-responsive drive assembly is a paddle wheel which includes a plurality of paddles.

4. The apparatus described in claim 1, further including:

a fertilizer containment chamber assembly supported by and contained within said body assembly wherein said fertilizer containment chamber assembly is placed in-line with said water flow path.

5. The apparatus described in claim 1 wherein said rotatable, water-tight connection assembly includes a stationary sealing surface connected to said body assembly and a rotatable sealing surface connected to said rotatable sprinkler head assembly.

6. The apparatus described in claim 1, further including;

a ground-contacting assembly connected to a bottom side of said body assembly for supporting said body assembly on a ground.

7. The apparatus described in claim 6 wherein said ground-contacting assembly is in a form of a helicopter ground-contacting assembly.

8. The apparatus described in claim 1, further including:

a ground-penetrating assembly connected to said body assembly for penetrating into a portion of ground for preventing said body assembly from moving along the ground.

* * * * *